US008784344B2

(12) United States Patent
Takahashi et al.

(10) Patent No.: US 8,784,344 B2
(45) Date of Patent: Jul. 22, 2014

(54) PELVIC FRAME AND WALKING ASSISTANCE DEVICE USING THE SAME

(75) Inventors: Hideaki Takahashi, Wako (JP); Hideo Shimizu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 864 days.

(21) Appl. No.: 12/975,571

(22) Filed: Dec. 22, 2010

(65) Prior Publication Data

US 2011/0160626 A1 Jun. 30, 2011

(30) Foreign Application Priority Data

Dec. 25, 2009 (JP) ..... 2009-295701

(51) Int. Cl.
*A61H 1/02* (2006.01)
*A61H 3/00* (2006.01)

(52) U.S. Cl.
CPC ..... *A61H 1/0244* (2013.01); *A61H 2201/5069* (2013.01); *A61H 2201/5061* (2013.01); *A61H 2201/165* (2013.01); *A61H 3/00* (2013.01)
USPC ..... 601/35; 601/533; 602/19; 602/23

(58) Field of Classification Search
USPC ..... 601/5, 23, 33, 34, 35, 84, 86, 90, 98; 602/5, 16, 19, 23, 24, 25, 26
See application file for complete search history.

(56) References Cited

U.S. PATENT DOCUMENTS 6,540,703 B1 * 4/2003 Lerman ..... 602/5
7,048,707 B2 * 5/2006 Schwenn et al. ..... 602/26
2011/0144551 A1 * 6/2011 Johnson ..... 602/19
2012/0245501 A1 * 9/2012 Rossi ..... 602/19
2012/0316476 A1 * 12/2012 Shimizu et al. ..... 601/35

FOREIGN PATENT DOCUMENTS

JP 2005-000634 A 1/2005
JP 2006-320351 11/2006
JP 2008-134086 6/2008

* cited by examiner

*Primary Examiner* — Quang D Thanh
(74) *Attorney, Agent, or Firm* — Rankin, Hill & Clark LLP

(57) ABSTRACT

A pelvic frame (20) for a walking assistance device (10) is configured to be worn on a pelvic part of a user, and comprises a main frame (22) extending from a lower back of the user to either side of the user, an abdominal belt (30) attached to the main frame at base ends thereof, extending along an inner periphery of the main frame (22) and configured to be detachably passed along an abdominal part of the user, and a pair of stabilizer member (90, 92) each having a base end attached to a free end part of the main frame (22) and a free end engaging the abdominal belt (30). Because the two free end of the main frame (22) are joined by the stabilizer members (90, 92) in cooperation with the abdominal belt (30), the stiffness and mechanical strength of the main frame (22) is effectively enhanced, and the weight of the main frame and material cost can be minimized. Also, the deformation of the pelvic frame (20) during use can be minimized, and this contributes to the comfort of the user. Also, as the stabilizer members (90, 92) hold up the corresponding parts of the abdominal belt (30) in readily accessible positions in spite of the flexibility of the abdominal belt (30), the wearing and removing of the pelvic frame (20) is simplified.

8 Claims, 3 Drawing Sheets

PELVIC FRAME AND WALKING ASSISTANCE DEVICE USING THE SAME

TECHNICAL FIELD

The present invention relates to a pelvic frame for a walking assistance device and a walking assistance device using the same, and in particular to a pelvic frame for a walking assistance device configured to apply a walking assistance force generated by a power generator to a lower limb of a user and a walking assistance device using the same.

BACKGROUND OF THE INVENTION

Previously proposed is a walking assistance device that includes a power generator such as an electric motor to apply a walking assistance force to a lower limb of a user for the purposes of assisting the walking movement of the user, and/or rehabilitating the walking impairment of the user. See Japanese laid open patent publications JP2006-320351A and JP2008-134086A (patent documents 1 and 2), for instance.

Such a walking assistance device typically includes a pelvic frame consisting of a C-shaped main frame configured to be worn on a pelvic part of the user and extending from a lower hack part of the user to either side of the pelvic part of the user, and an abdominal belt for securing the main frame to the pelvic part of the user. Each free end of the main frame is fitted with a power generator that applies a walking assistance force to the lower limb of the user.

The pelvic frame is designed to secure the power generator for producing the walking assistance force to the pelvic part of the user, and is required to be able to support the reaction of the force (torque) produced by the power generator (in particular, the reactive torque around a pivot center of the hip joint) and favorably fit on the user without causing any discomfort.

However, the conventional arrangement was not totally satisfactory in this regard. More specifically, as the pelvic frame had a limited capacity in preventing the rotation of the pelvic frame around the pivot center of the hip joint when the pelvic frame is worn by the user, the reaction of the walking assistance force produced by the power generator is not adequately supported, and this caused the twisting of a part of the pelvic frame.

The pelvic frame is desired to be worn and removed with as little effort as possible, but the previously proposed pelvic frames were not totally satisfactory in this regard. In particular, the user of the pelvic frame may be handicapped in some cases, and there is an acute need for simplifying the wearing and removing of the pelvic frame.

BRIEF SUMMARY OF THE INVENTION

In view of such problems of the prior art, a primary object of the present invention is to provide a pelvic frame for a working assistance device that can adequately support the reaction of the force (torque) produced by the power generator and favorably fit on the user without causing any discomfort.

A second object of the present invention is to provide a pelvic frame for a working assistance device that facilitates the wearing of the pelvic frame by a user.

A third object of the present invention is to provide a walking assistance device incorporated with such a pelvic frame.

To achieve such objects, the present invention provides a pelvic frame for a walking assistance device, the walking assistance device being configured to apply a walking assistance force generated by a power generator to a lower limb of a user, comprising: a main frame configured to be worn on a pelvic part of a user and extending from a lower back of the user to either side of the pelvic part of the user forming a C-shape in plan view, each free end of the main frame being configured to support the power generator at a position corresponding to a hip joint of the user; an abdominal belt attached to the main frame at a base end thereof, extending along an inner periphery of the main frame and configured to be detachably passed along an abdominal part of the user; and a pair of stabilizer member each having a base end attached to a free end part of the main frame and a free end engaging the abdominal belt.

Because the two free end of the main frame are joined by the stabilizer members in cooperation with the abdominal belt, the stiffness and mechanical strength of the main frame is effectively enhanced, and the deformation of the pelvic frame during use can be minimized. The reduction in the deformation of the pelvic frame contributes to the comfort of the user.

Also, as the stabilizer members hold up the corresponding parts of the abdominal belt in readily accessible positions in spite of the flexibility of the abdominal belt, the wearing and removing of the pelvic frame is simplified.

According to a preferred embodiment of the present invention, each stabilizer member is substantially more flexible in lateral bending than in vertical bending. Thereby, the stabilizer member is given with a flexibility in the lateral direction for an improved fit on the body of the user and a stiffness required for the stabilizer member to withstand the compressive and other loads may be applied thereto during use.

According to a particularly preferred embodiment of the present invention, each stabilizer member comprises a plate member having a vertically elongated cross section, and a substantially vertically oriented major plane, and the base end of each stabilizer member is pivotally connected to the main frame so as to be rotatable around an axial line extending perpendicular to the major plane of the stabilizer member. Furthermore, each stabilizer member may extend in an upwardly oblique direction from the base end thereof to the free end thereof for a favorable support of the main frame in cooperation with the abdominal belt.

According a certain aspect of the present invention, the abdominal belt comprises a pair of side belts each having a base end secured to the main frame and extending forwardly along corresponding sides of the user, and a front belt releasably connected between free ends of the side belts, the stabilizer members engaging parts of the side belts.

According to another aspect of the present invention, the abdominal belt comprises a pair of side belts each having a base end secured to the main frame and extending along corresponding sides of the user and across a front part of the user, free ends of the side belts being releasably secured to opposite sides of the main frame, and the stabilizer members engaging parts of the side belts.

The present invention also provides a walking assistance device, comprising: a pelvic frame including a main frame configured to be worn on a pelvic part of a user and extending from a lower back of the user to either side of the pelvic part of the user, each free end of the main frame being configured to support the power generator at a position corresponding to a hip joint of the user, an abdominal belt extending along an inner periphery of the main frame and configured to be detachably passed along an abdominal part of the user, and a pair of stabilizer member each having a based end attached to a free end part of the main frame and a free end engaging the abdominal belt; a power generator attached to each free end of the main frame; a power transmitting member extending from an output end of each power generator and a femoral part of a user for an angular movement around a center of rotation corresponding to a hip joint of the user.

DETAILED DESCRIPTION OF THE PREFERRED EMBODIMENTS

Figure 1:
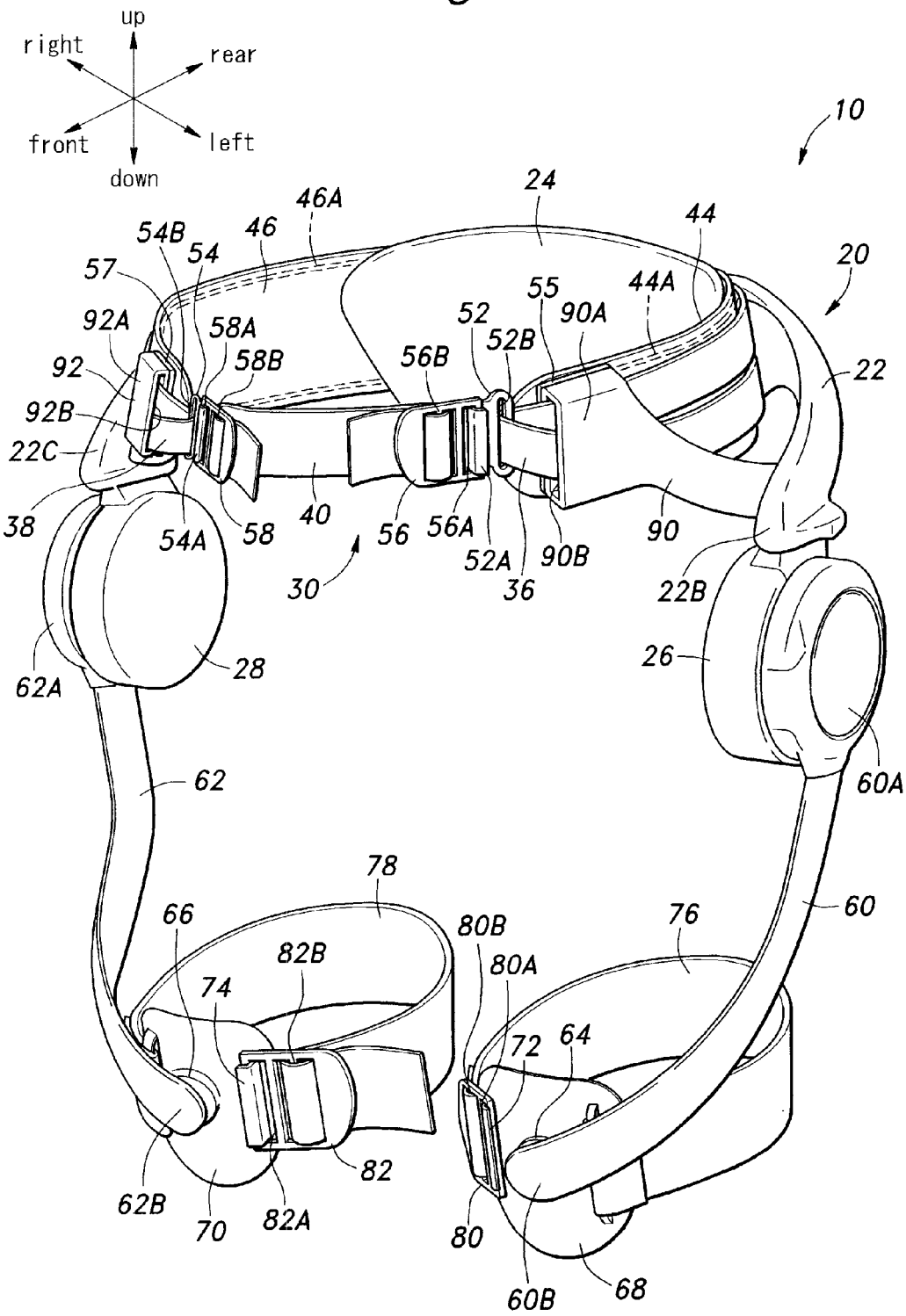
FIG. 1 is a perspective view showing an embodiment of the pelvic frame and the walking assistance device of this present invention.
Figure 2:
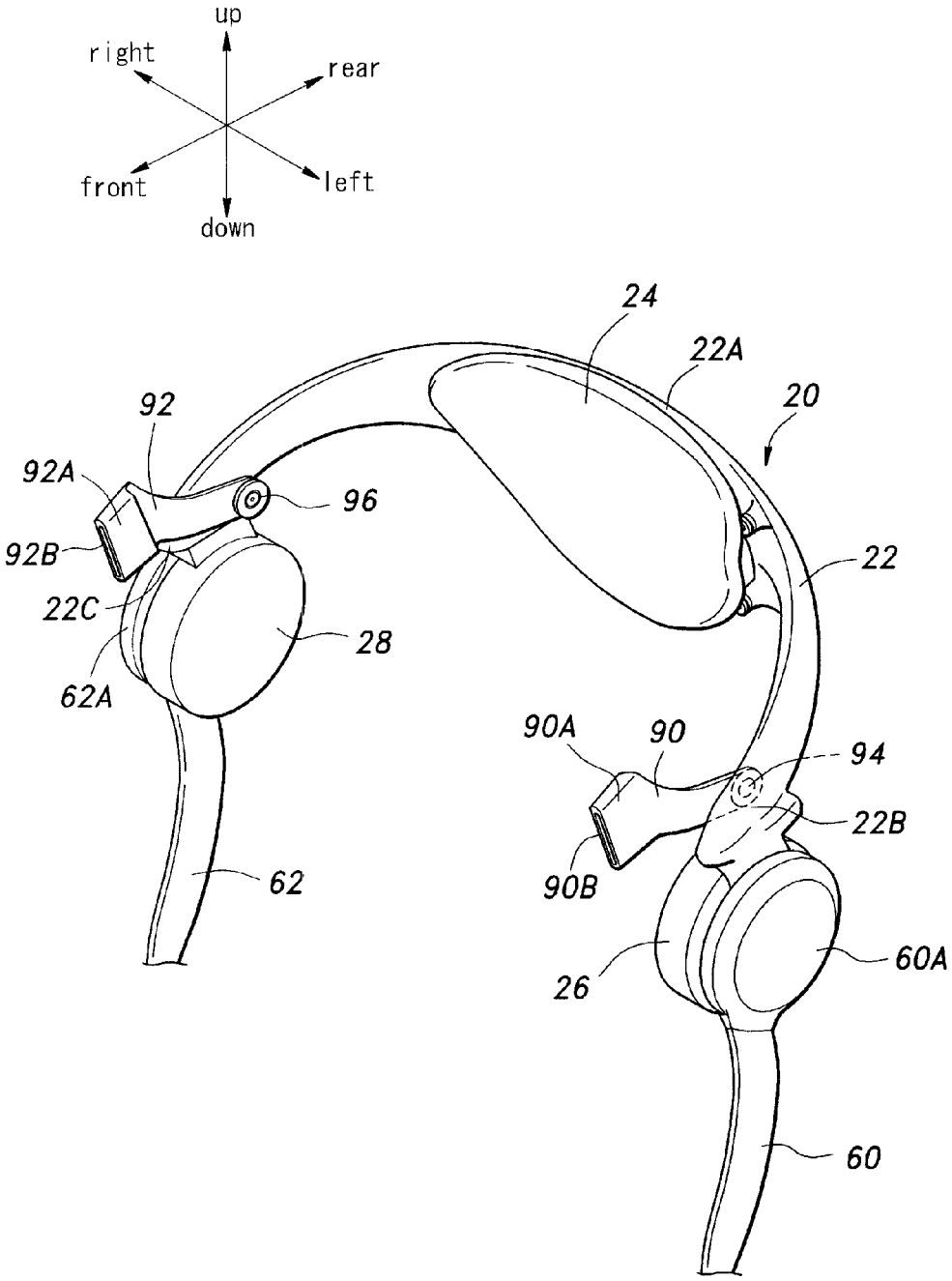
FIG. 2 is a fragmentary perspective view showing the pelvic frame and the walking assistance device with the abdominal belt omitted for the clarity of illustration.

An embodiment of the walking assistance device of the present invention will now be described in the following with reference to FIGS. 1 and 2. In the succeeding description, the direction of the walking assistance device will be based on the directional arrows shown in each of the drawings. When the device is worn by the user, the front and back directions of the walking assistance device coincide with the coronal axis, while the left and right directions coincide with the sagittal axis.

The walking assistance device 10 is provided with a pelvic frame 20. The pelvic frame 20 is configured to be worn on the pelvic part of the user, and includes a main frame 22 that extends outwardly from a lower back part of the user to either side of the pelvic part to form a C-shape when viewed in plan view. The main frame 22 is formed with molded plastic material such as polyamide resin, glass fiber reinforced plastic material, carbon fiber reinforced plastic material or other material having a high stiffness and mechanical strength.

A back pad 24 is attached to the inner side of a middle part 22A (FIG. 2) of the main frame 22. A left end part 22B and a right end part 22C on either side of the main frame 22 are positioned outwardly on either side of the user, and are each provided with a power generator mainly consisting of a motor unit 26, 28. The upper end of each motor unit is connected to the corresponding end part 22B, 22C of the main frame 22 via a hinge having a hinge axis extending in the coronal axis (front/back directional axis) of the user so that the motor unit is suspended from the end part, and can rotate around the hinge axis within a prescribed angular range.

Along the inner side of the main frame 22 extends an abdominal belt 30, which is wrapped around the abdominal part of the user. The abdominal belt 30 of this embodiment includes a left side belt 36, a right side belt 38 and a front belt 40. These parts 36, 38 and 40 are each made of flexible materials such as fabric and leather.

The left side belt 36 is passed through an opening 52B of a left engagement piece 52, and the two ends of the left side belt 36 are attached to an upper and lower part of the inner side of the middle part 22A of the main frame 22, respectively, so as to form a loop. Therefore, the left side belt 36 is reversed over in the shape of letter V at the left engagement piece 52. The length of the left side belt 36 can be adjusted by using a belt length adjustment buckle (not shown in the drawings) provided in a middle part of the belt. The left hook engagement piece 52 is made of plastic or metallic material, and is further provided with a left hook shaped part 52A.

Similarly, the right side belt 38 is passed through an opening 54B of a right engagement piece 54, and the two ends of the right side belt 38 are attached to an upper and lower part of the inner side of the middle part 22A of the main frame 22, respectively, so as to form a loop. Therefore, the right side belt 38 is reversed over in the shape of letter V at the right engagement piece 54. The length of the right side belt 38 can be adjusted by using a belt length adjustment buckle (not shown the drawings) provided in a middle part of the belt. The right hook engagement piece 54 is made of plastic or metallic material, and is further provided with a right hook shaped part 54A.

In the illustrated embodiment, each of the left and right buckles 52 and 54 are each made of a flat plate member having a slightly greater width than the belts.

Each end of the front belt 40 is fitted with a buckle 56, 58 provided with an opening 56A, 56B configured to receive the hook shaped part of the corresponding engagement piece 52, 54. Each of the buckle 56, 58 is provided with a pair of rectangular openings 56B, 58B for passing the corresponding end of the front belt 40 in a length adjustable manner. The left and right buckles 56 and 58 are each made of a flat plate member having a slightly greater width than the belt 40.

Therefore, the front belt 40 can be detachably connected to the left and right side belts 36 and 38 by engaging the hook shaped part of each engagement piece 52, 54 with the opening 56A, 56B of the corresponding buckle 56, 58. When the three parts of the abdominal belt 30 are connected to one another as described above, the abdominal belt 30 forms a loop that surrounds the abdominal part of the user. By suitably adjusting the length of each part of the abdominal belt 30 and snugly wrapping the abdominal belt 30 around the abdominal part of the user, the main frame 22 can be securely fitted to the pelvic part user without causing discomfort to the user.

The pelvic frame 20 further comprises a left supporter piece 44 and a right supporter piece 46. Each supporter piece 44, 46 are made of relatively stiff sheet member having a vertical width greater than the combined width of the two runs of the corresponding abdominal belt 36, 38 extending along the outer surface of the supporter piece 44, 46. To impart a suitable stiffness to each supporter piece 44, 46, a resilient plastic wire 44A, 46A may be incorporated in the supporter piece 44, 46, for instance, along the outer periphery thereof.

Thus, the supporter pieces 44 and 46 are flexible enough to conform to the contour of the pelvic part of the user but stiff enough to distribute the pressure from the left and right side belts 36 and 38 over a large area of the body of the user so that the comfort of the user may be enhanced. Also, in order to increase the air breathability, and ensure the comfort to the user in a warm weather, the supporter pieces 44 and 46 may be at least partly made of a mesh type fabric or other air permeable material.

The base end of the left supporter piece 44 is secured to the middle part 22A of the main frame 22, and extends between the back pad 24 and left abdominal belt 36. The free end of the left supporter piece 44 terminates at a point adjacent to the left engagement piece 52 in the illustrated embodiment, but may also extend slightly beyond the left engagement piece 52. The right supporter piece 46 extends along the side of the user in a similar fashion as the left supporter piece 44.

Similarly, the base end of the right supporter piece 46 is secured to the middle part 22A of the main frame 22, and extends between the back pad 24 and right abdominal belt 38. The free end of the right supporter piece 46 terminates at a point adjacent to the right engagement piece 54 in the illustrated embodiment, but may also extend slightly beyond the left engagement piece 52. The right supporter piece 46 extends along the side of the user in a similar fashion as the left supporter piece 44.

A stabilizer member 90, 92 is connected to each end part 22B, 22C of the main frame 22. Each stabilizer is made of an elongated, relatively stiff plastic member having a base end pivotally attached to the inner side of the corresponding end part 22B, 22C via a pivot member 94, 96 (FIG. 2) so as to be rotatable around a pivot axis substantially in parallel with the sagittal axis or so as to be rotatable in the vertical direction.

Each stabilizer member 90, 92 has a free end 90A, 92A formed with a passage 90B, 92B through which the two runs of the corresponding side belt 36, 38 are passed. The passage 90B, 92B has a certain length so that the stabilizer member 90, 92 may evenly engage a corresponding length of each run of the belt. The free end 90A, 92A of each stabilizer member 90, 92 is attached to a free end part of the corresponding supporter piece 44, 46 via a cushioning member 55, 57 such as a foamed plastic piece.

The stabilizer member 90, 92 is made of a relatively stiff molded elastomeric material such as vulcanized rubber. The main part of each stabilizer member 90, 92 consists of a strip member having a relatively large width as compared to the thickness thereof and having a major plane extending along the outer contour of the abdominal part of the user. Therefore, the stabilizer member 90, 92 is compliant in the direction to conform to the outer contour of the abdominal part of the user, but is relatively stiff against the bending deformation in the vertical direction.

Each electric motor unit 26, 28 is positioned so as to coincide with the corresponding hip join of the user, and is provided with an angular sensor (not shown in the drawings). To the output end of each electric motor unit 26, 28 on the exterior side thereof is releasably attached a base end part 60A, 62A of a swing arm (femoral frame) 60, 62 in a torque transmitting relationship.

Each swing arm 60, 62 is made of highly stiff and strong material such as aluminum, glass fiber reinforced plastic material, and carbon fiber reinforced plastic material. The main part of each swing arm 60, 62 consists of a flat bar whose major surface extends perpendicularly to the sagittal axial at the base end 60A, 62A thereof. Each swing arm 60, 62 is generally twisted so that the major plane of the free end 60B, 62B, which is located adjacent to a lower end of the femoral part, extends perpendicularly to the coronal axis.

The free end 60B, 62B of each swing arm 60, 62 is fitted with a front femoral support member 68, 70 via a coupling 64, 66 that permit angular movement of the femoral support member 68, 70 relative to the free end 60B, 62B of the swing arm 60, 62.

Each femoral support member 68, 70 is integrally formed with a hook-shaped part 72, 74 on one lateral side of the outer or front surface thereof. A base end of a femoral belt 76, 78 is connected to the other lateral side of the femoral support member 68, 70, and a free end of the femoral belt 76, 78 connected to a belt adjustment buckle 80, 82 via a pair of openings 80B, 82B formed in the buckle that allow the length of the belt. The buckle 80, 82 is further provided with an opening 80A, 82A configured to engage the hook-shaped part 72, 74 of the corresponding femoral support member 68, 70 when the femoral belt 76, 78 is passed around the lower part of the femoral part of the user. The femoral belts 76 and 78 may be made of any flexible material such as fabric, leather and plastic material.

Thus, the free end of each swing arm 60, 62 can engage the lower part of the corresponding femoral part of the user by passing the femoral belt 76, 78 around the femoral part of the user, and engaging the hook-shaped part 72, 74 with the opening 80A, 82A. By appropriately tightening the femoral belt 76, 78 by using the buckle 80, 82, the femoral part of the user can be securely but releasably engaged by the free end of the swing arm 60, 62.

This walking assistance device 10 can be worn by the user in the following way. With the swing arms 60, 62 detached from the pelvic frame 20, the user places the pelvic frame 20 around the pelvic part of the user either by himself or with the aid of a caregiver, and connects the two free ends of the side belts 36 and 38 with the front belt 40 by engaging the hook shaped parts 52A and 54A of the engagement pieces 52 and 54 with the openings 56A and 58A of the corresponding buckles 56 and 58, respectively. The abdominal belt 30 can be then tightened as required by using the tension adjusting features provided in the three parts of the abdominal belt 30.

Thereafter, the right and left swing arms 60 and 62 may be connected to the corresponding motor units 26 and 28, respectively. Each femoral belt 76, 78 is passed around the corresponding femoral part of the user, and the hook-shaped part 72, 74 is engaged with the opening 80A, 82A of the corresponding buckle 80, 82. By appropriately tightening the femoral belts 76 and 78, the femoral parts of the user can be securely engaged by the free ends of the swing arms 60, 62, respectively.

The removal of the walking assistance device 10 can be accomplished by reversing this procedure.

By actuating the motor units 26 and 28 in dependence on the walking effort made by the user (which can be detected by using suitable load sensors not shown in the drawings), the user is assisted in the effort to walk not only by the assisting power provided by the motor units 26 and 28 but also by the gait or pace also provided by the motor units 26 and 28 for the purpose of helping the user regain the motor coordination required for walking. The motor units 26 and 28 are provided with angular sensors so that the angular movements of the motor units 26 and 28 may be accurately controlled by feedback control.

When the pelvic frame 20 is worn by the user, the end part 90A, 92A of each stabilizer member 90, 92 can be positioned adjacent to the anterior superior iliac spine of the user because the stabilizer member 90, 92 is forced toward the body of the user by the corresponding side belt 36, 38 and is adequately flexible in the lateral (horizontal) direction to accommodate such a movement of the stabilizer member 90, 92.

Thus, the main frame 22 is firmly supported on the user at three locations, the middle part 22A supported by the lower back part of the user via the back pad 24, and the two end parts 22B and 22C are each supported by the corresponding anterior superior iliac spine of the user via the stabilizer member 90, 92. In particular, each stabilizer member 90, 92 is given with a relative high stiffness against vertical bending owing to the vertically elongated cross section thereof and laterally held against the body contour of the user so that the stabilizer member 90, 92 is enabled to support not only a tensile force but also a compressive load applied thereto. Therefore, the stabilizer members 90, 92 are highly effective in supporting the end parts 22B and 22C of the main frame 22 to the pelvic part of the user.

The left supporter piece 44 and right supporter piece 46 allow the abdominal belt 30 to be tightly fastened around the abdominal part of the user without causing any discomfort to the user and/or slippage of the abdominal belt 30 because the left supporter piece 44 and right supporter piece 46 distribute the pressure of the abdominal belt 30 over a large area of the body of the user.

When each electric motor unit 26, 28 is driven, the resulting reaction force (torque around the rotational center of the motor unit 26, 28) thereof is transmitted to the main frame 22 so that the main frame 22 receives a twisting force from the corresponding end part 22B, 22C. The stabilizer members 90 and 92 are highly effective in supporting the main frame 22 against such a twisting deformation, in cooperation with the back pad 24. As discussed above, the stabilizer members 90 and 92 are given with a favorable cross section geometry that allows stabilizer members 90 and 92 to conform favorably to the outer contour of the body of the user while providing an adequate stiffness (owing to the high stiffness against vertical bending) against compressive load applied thereto.

More specifically, the stabilizer members 90 and 92 are enabled to withstand the compressive and tensile load required for supporting the main frame 22 to the body of the user in a stable manner and to conform to the body of the user for the comfort of the user and an enhanced load supporting capability of the pelvic frame 20.

As the two terminal ends (22B and 22C) are joined to each other by the stabilizer members 90 and 92 and the abdominal belt 30, the overall stiffness of the pelvic frame 20 can be enhanced. This reduces the need for the main frame 22 to be unduly stiff and hence bulky and/or heavy by itself as compared to the conventional arrangement where the terminal ends of the pelvic frame is not connected. The control of the deformation of the pelvic frame 20 during the operation of the walking assistance device contributes to the comfort of the user as can be readily appreciated by a person skilled in the art. For instance, the main frame 22 can be made of relatively inexpensive material such as polyamide resin, instead of more expensive materials such as carbon fiber reinforced plastic material.

The pelvic frame 20 of the illustrated embodiment can be worn and removed both quickly and simply. Simply by engaging the hooked shaped parts 52A and 54A of the engagement pieces 52 and 54 with the openings 56A and 58A of the corresponding buckles 56 and 58, the pelvic frame 20 can be worn by the user. If desired, the length of the abdominal belt 30 may be suitably adjusted.

The removal of the pelvic frame 20 of the illustrated embodiment can be accomplished in an equally quick and simple manner. Simply disengaging at least one of the hooked shaped parts 52A and 54A of the engagement pieces 52 and 54 from the corresponding openings 56A and 58A of the corresponding buckles 56 and 58 (or the opening of the corresponding buckle), the pelvic frame 20 can be removed from the user.

In particular, the engagement pieces 52 and 54, along with the corresponding ends of the side belts 36 and 38, are supported in position by the stabilizer members 90 and 92 without drooping even after the front belt 40 is removed or otherwise released. This facilitates the wearing and removal of the pelvic frame 20 even further so that the pelvic frame 20 can be worn and removed even with a single hand.

According to the illustrated embodiment, the front belt 40 is connected to the two side belts 36 and 38 at either terminal end. Therefore, the abdominal belt 30 and hence pelvic frame 20 can be released by disengaging one end of the front belt 40 from the corresponding side belt 36, 38. Therefore, a handicapped person having impairment on either arm can fasten and release the abdominal belt 30 with the use of the one hand that is not impaired.

Also, based on the pelvic frame 20 of the present embodiment, a clearance gap is formed between the abdominal belt 30 and the adjacent parts of the end parts 22B and 22C of the main frame 22 so that a hand can be placed in the clearance gap, enabling a rehabilitation personnel or a medical practitioner to provide better support from the back of the user, helping to the user to wear the pelvic frame 20, and otherwise facilitating the rehabilitation.

Figure 3:
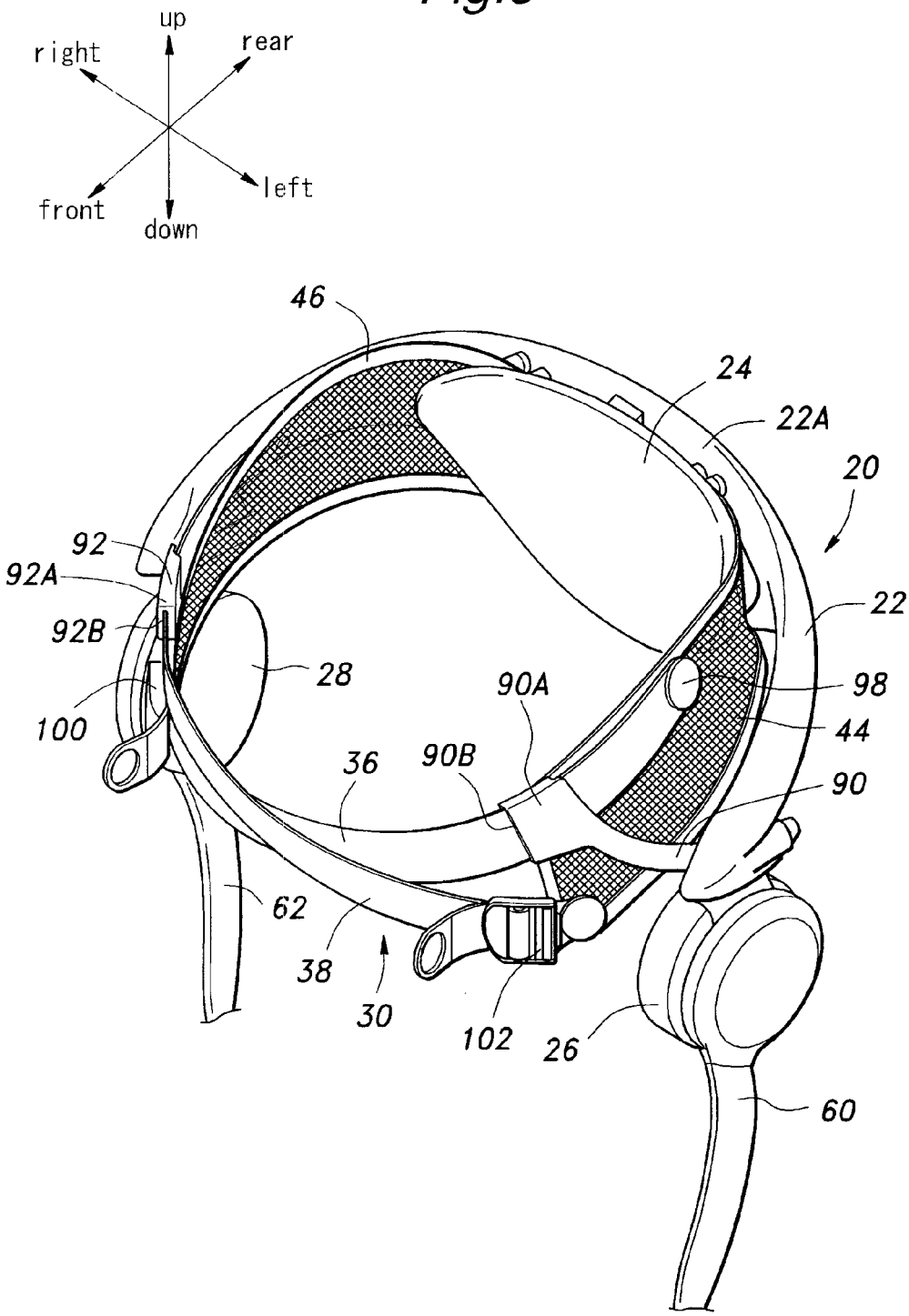
FIG. 3 is a perspective view showing the second embodiment of the pelvic frame and the walking assistance device.

FIG. 3 shows a second embodiment of the present invention. In FIG. 3, the parts corresponding to those of the previous embodiment are denoted with like reference numerals without repeating the description of such parts.

Referring to FIG. 3, the second embodiment differs from the first embodiment in the structure of the abdominal belt 30. The abdominal belt 30 includes a left side belt 36 having a base end pivotally connected to an upper part of a length-wise intermediate part 98 of the left supporter piece 44 and a free end releasably connected to a lower part of a free end portion of the right supporter piece 46 via a buckle 100, and a right side belt 38 having a base end pivotally connected to an upper part of a length-wise intermediate part 98 of the right supporter piece 46 and a free end releasably connected to a lower part of a free end portion of the left supporter piece 44 via a buckle 102. Therefore, the two side belts 36 and 38 cross each other at the front part of the abdominal part of the user. The front belt 40 of the previous embodiment is omitted in the second embodiment.

The buckles 100 and 102 may be similar to the buckles 56 and 58 of the previous embodiment, and may be configured to be readily engaged and disengaged with and from engagement features provided on the supporter pieces 44 and 46. The buckles 100 and 102 may be additionally provided with features for adjusting the lengths of the corresponding side belts 36 and 38. In this embodiment also, the side belts 36 and 38 are passed through the passages 90B and 92B of the corresponding stabilizer members 90 and 92.

In this embodiment also, the main frame 22 is firmly supported on the user at three locations, the middle part 22A supported by the lower back part of the user via the back pad 24, and the two end parts 22B and 22C each supported by the corresponding anterior superior iliac spine of the user via the stabilizer member 90, 92. In particular, each stabilizer member 90, 92 is given with a relative high stiffness against vertical bending owing to the vertically elongated cross section thereof and laterally held against the body contour of the user so that the stabilizer member 90, 92 is enabled to support not only a tensile force but also a compressive load applied thereto. Therefore, the stabilizer members 90, 92 are highly effective in supporting the end parts 22B and 22C of the main frame 22 to the pelvic part of the user.

Also, the two terminal ends of the main frame are joined by the two side belts 36 and 38 for the improved stiffness of the main frame 22. The X-shaped crossing of the two side belts 36 and 38 provides an improved support of the lower abdominal part of the user.

The illustrated embodiments are merely exemplary of the present invention. For instance, the buckles of the illustrated embodiments can be replaced with any known buckles and surface fasteners without departing from the spirit of the present invention. The same is true with the arrangements for adjusting the length of the belts. If desired, the free ends or any other parts of the two supporter pieces 44 and 46 may be joined by a pair of side belts that are configured to be simply passed through the passages of the corresponding stabilizer members, and releasably joined at a front part intermediate between the two stabilizer members.

Although the present invention has been described in terms of preferred embodiments thereof, it is obvious to a person skilled in the art that various alterations and modifications are possible without departing from the scope of the present invention which is set forth in the appended claims.

The contents of the prior art references mentioned in this application and the original Japanese patent application on which the Paris Convention priority claim is made for the present application are incorporated in this application by reference.

LIST OF REFERENCE NUMERALS

10 walking assistance device
20 pelvic frame
22 main frame
24 back pad
26 left motor unit
28 right motor unit
30 abdominal belt
36 left side belt
38 right side belt
40 front belt
44 left supporter belt
46 right supporter belt
52, 54 engagement piece
56, 58 buckle
60, 62 swing arm
68, 70 femoral support member
76, 78 femoral belt
90 left stabilizer member
92 right stabilizer member
100, 102 buckle

The invention claimed is:

1. A pelvic frame for a walking assistance device, the walking assistance device being configured to apply a walking assistance force generated by a power generator to a lower limb of a user, comprising:

a main frame configured to be worn on a pelvic part of a user and extending from a lower back of the user to either side of the pelvic part of the user forming a C-shape in plan view, each free end of the main frame being configured to support the power generator at a position corresponding to a hip joint of the user;

an abdominal belt attached to the main frame at base ends thereof, extending along an inner periphery of the main frame and configured to be detachably passed along an abdominal part of the user; and a pair of stabilizer member each having a base end attached to a free end part of the main frame and a free end engaging the abdominal belt.

2. The pelvic frame for a walking assistance device according to claim 1, wherein each stabilizer member is substantially more flexible in lateral bending than in vertical bending.

3. The pelvic frame for a walking assistance device according to claim 2, wherein each stabilizer member comprises a plate member having a vertically elongated cross section, and a substantially vertically oriented major plane.

4. The pelvic frame for a walking assistance device according to claim 3, wherein the base end of each stabilizer member is pivotally connected to the main frame so as to be rotatable around an axial line extending perpendicular to the major plane of the stabilizer member.

5. The pelvic frame for a walking assistance device according to claim 1, wherein each stabilizer member extends in an upwardly oblique direction from the base end thereof to the free end thereof.

6. The pelvic frame for a walking assistance device according to claim 1, wherein the abdominal belt comprises a pair of side belts each having a base end secured to the main frame and extending forwardly along corresponding sides of the user, and a front belt releasably connected between free ends of the side belts, the stabilizer members engaging parts of the side belts.

7. The pelvic frame for a walking assistance device according to claim 1, wherein the abdominal belt comprises a pair of side belts each having a base end secured to the main frame and extending along corresponding sides of the user and across a front part of the user, free ends of the side belts being releasably secured to opposite sides of the main frame, and the stabilizer members engaging parts of the side belts.

8. A walking assistance device, comprising:

a pelvic frame including a main frame configured to be worn on a pelvic part of a user and extending from a lower back of the user to either side of the pelvic part of the user, each free end of the main frame being configured to support the power generator at a position corresponding to a hip joint of the user, an abdominal belt extending along an inner periphery of the main frame and configured to be detachably passed along an abdominal part of the user, and a pair of stabilizer member each having a based end attached to a free end part of the main frame and a free end engaging the abdominal belt;

a power generator attached to each free end of the main frame;

a power transmitting member extending from an output end of each power generator and a femoral part of a user for an angular movement around a center of rotation corresponding to a hip joint of the user.

* * * * *